US009576754B2

(12) United States Patent
Arnst et al.

(10) Patent No.: US 9,576,754 B2
(45) Date of Patent: Feb. 21, 2017

(54) LOCKOUT DEVICES FOR ELECTRICAL CONTROL SWITCHES

(71) Applicants: Tim Arnst, Clatskanie, OR (US); Steven Hicks, Tualatin, OR (US)

(72) Inventors: Tim Arnst, Clatskanie, OR (US); Steven Hicks, Tualatin, OR (US)

( * ) Notice: Subject to any disclaimer, the term of this patent is extended or adjusted under 35 U.S.C. 154(b) by 219 days.

(21) Appl. No.: 14/506,960

(22) Filed: Oct. 6, 2014

(65) Prior Publication Data

US 2015/0122618 A1 May 7, 2015

Related U.S. Application Data

(60) Provisional application No. 61/900,215, filed on Nov. 5, 2013.

(51) Int. Cl.
*H01H 9/28* (2006.01)
*H01H 9/16* (2006.01)

(52) U.S. Cl.
CPC ..... *H01H 9/287* (2013.01); *H01H 9/161* (2013.01)

(58) Field of Classification Search
CPC ..... H01H 9/282; H01H 9/20; H01H 9/286; H01H 9/285
USPC ..... 200/43.11, 43.15, 43.19, 43.22
See application file for complete search history.

(56) References Cited

U.S. PATENT DOCUMENTS 3,391,554 A * 7/1968 Wrenshall ..... F16K 35/10 70/178
4,254,888 A * 3/1981 Chandler ..... B60K 15/0409 220/210
5,077,452 A * 12/1991 Mathers ..... H01H 9/287 174/66
5,238,141 A * 8/1993 Callegari ..... F17C 13/002 137/382
5,638,858 A * 6/1997 Gettinger ..... F16K 27/12 137/382
5,732,815 A * 3/1998 Brouwer ..... H01H 9/283 200/43.11
6,170,306 B1 * 1/2001 Kitley ..... F16K 35/10 137/382
6,206,033 B1 * 3/2001 Chang ..... F16K 35/10 137/377
6,972,387 B2 * 12/2005 Berthaud ..... H01H 9/282 200/322
8,074,960 B2 * 12/2011 Milbeck ..... F16K 35/10 251/90
8,770,220 B1 * 7/2014 Embry ..... A62C 35/20 137/382

(Continued)

*Primary Examiner* — Renee Luebke
*Assistant Examiner* — Ahmed Saeed
(74) *Attorney, Agent, or Firm* — Mohr Intellectual Property Law Solutions, P.C.

(57) ABSTRACT

Electrical switch lockout devices for selectively maintaining a position of an electrical switch on an electrical switch base are described. The electrical switch lockout devices include a base adapter configured to be fitted around the electrical switch base, a housing that is moveable between an engaged position and a disengaged position, and a locking mechanism. The housing includes walls, an opening on one side of the housing, a first lateral lip disposed on a first edge of the opening, and a second lateral lip disposed a second edge of the opening. The first lateral lip and the second lateral lip are configured to engage and disengage with the base adapter in the engaged and disengaged positions, respectively.

18 Claims, 8 Drawing Sheets

(56) References Cited

U.S. PATENT DOCUMENTS

| | | | | |
|---|---|---|---|---|
| 2012/0047973 | A1* | 3/2012 | Su | G05G 5/02 70/174 |
| 2014/0196792 | A1* | 7/2014 | Torres-Leon | F16K 27/12 137/1 |

* cited by examiner

LOCKOUT DEVICES FOR ELECTRICAL CONTROL SWITCHES

CROSS REFERENCE TO RELATED APPLICATIONS

This application claims priority to U.S. Provisional Patent Application, Ser. No. 61/900,215, filed on Nov. 5, 2013, which is hereby incorporated by reference for all purposes.

BACKGROUND

The present disclosure relates generally to lockout devices for electrical control switches. In particular, lockout devices that releasably cover an electrical control switch such that it may be safely maintained in a desired position are described.

For operation of electrical systems, circuit breakers and other electrical control switches are used for regulation of electrical currents. During maintenance and/or other operational procedures, it may be required that potentially dangerous electrical currents are prevented from being circulated through the system. In such a case, it is desirable that one or more of the circuit breakers and electrical control switches be secured in an OFF position to restrict accidental or unauthorized manipulation. Generally, lockout mechanisms and devices, such as lockout tags and lockout boxes, are used to restrict access to circuit breakers and electrical control switches.

Known lockout mechanisms and devices are not entirely satisfactory for the range of applications in which they are employed. For example, there are no established standards for size and shape of electrical control switches. Many existing lockout mechanisms and devices attach directly to an electrical control switch, and are therefore specific to only a certain type of switch. If such lockout mechanisms are improperly used with an incorrect type of electrical control switch, the lockout mechanism may not be effective.

Further, as many electrical control switches are curved or tapered, gripping of a lockout mechanism to the switch itself may be ineffective. In some cases, lockout devices may be removed from an electrical control switch while still in the locked state. Other lockout devices attach over a switch, but prevent viewing of the position of the switch (to ensure that it is in the OFF position) and require complicated attachment components. In addition, conventional lockout mechanisms and devices do not provide notification to a user of when the lockout device was applied, why it was applied, who applied the device, or the intended duration of lockout.

Thus, there exists a need for lockout devices that improve upon and advance the design of known lockout mechanisms. Examples of new and useful lockout devices relevant to the needs existing in the field are discussed below.

SUMMARY

The present disclosure is directed to electrical switch lockout devices for selectively maintaining a position of an electrical switch on an electrical switch base. The electrical switch lockout devices include a base adapter configured to be fitted around the electrical switch base, a housing that is moveable between an engaged position and a disengaged position, and a locking mechanism. The housing includes walls, an opening on one side of the housing, a first lateral lip disposed on a first edge of the opening, and a second lateral lip disposed a second edge of the opening. The first lateral lip and the second lateral lip are configured to engage and disengage with the base adapter in the engaged and disengaged positions, respectively.

DETAILED DESCRIPTION

Figure 1:
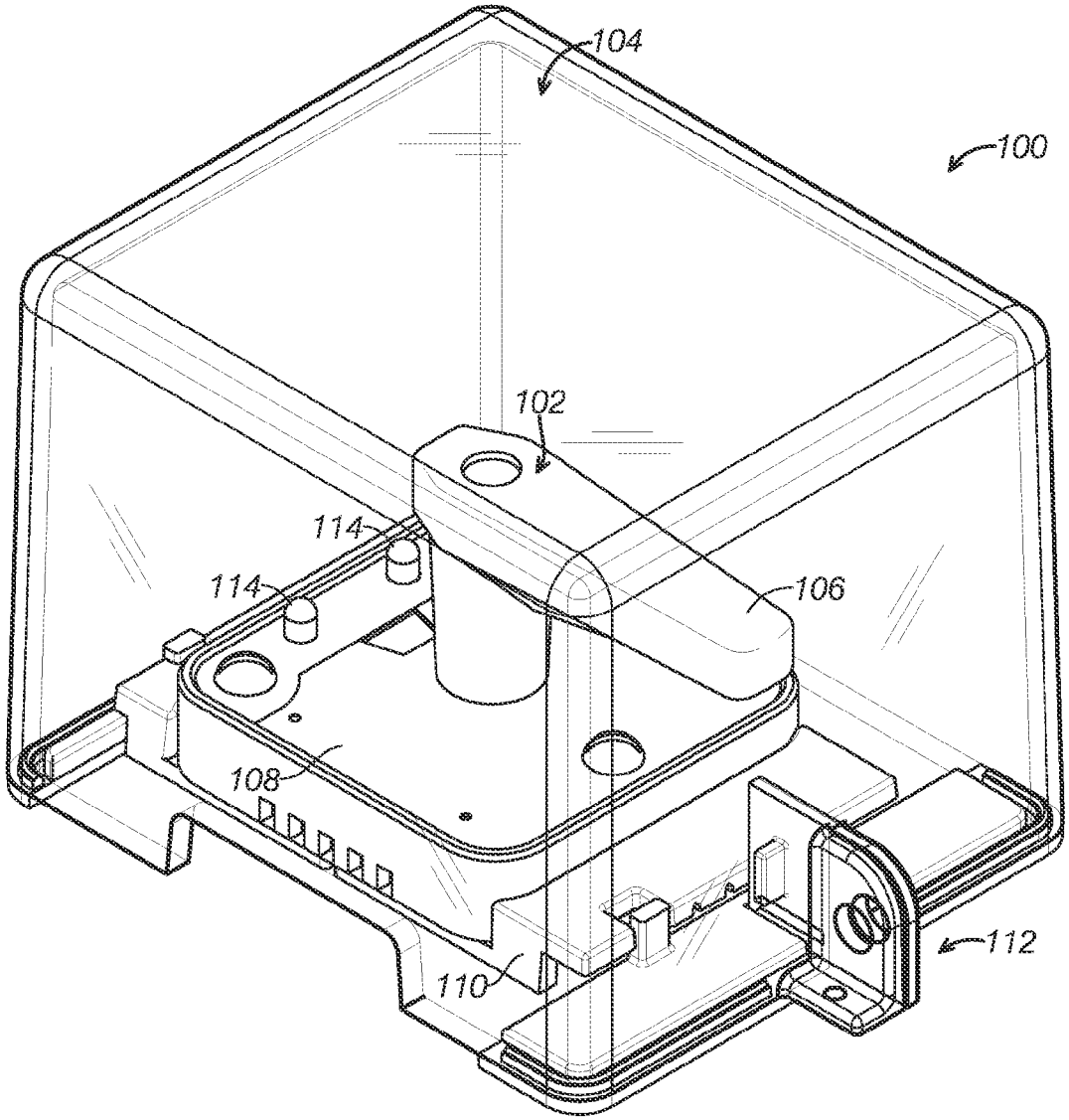
FIG. 1 is a perspective view of a first example of a lockout device releasably secured to an electrical control switch.

The disclosed lockout devices will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description. Specifically, the presently described and depicted electrical control switch and lockout device are shown and described in only a single orientation. It will be appreciated that the electrical control switch may be mounted on a side wall, floor, or ceiling and the lockout device can be used to cover a control switch in any of these orientations.

Throughout the following detailed description, a variety of lockout device examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-8C, a first example of a lockout device, lockout device 100, will now be described. Lockout device 100 functions to releasably cover an electrical control switch, such as electrical control switch 102. Additionally, lockout device 100 can be locked such that a housing 104 of the lockout device is held in a fixed position (substantially covering the electrical control switch) and a desired position of the electrical control switch (e.g., an OFF position) can be securely maintained. Lockout device 100 can be unlocked and removed when the desired position of the electrical control switch is no longer required. Additionally, lockout device 100 is fabricated from a clear plastic material (e.g., plexiglass, acrylic, butyrate, lexan, PETG, etc.) that permits viewing of the electrical control switch and is suitable for marking with a felt pen.

Lockout device 100 addresses many of the shortcomings existing with conventional lockout devices. For example, lockout device 100 may be operable with a wide variety of electrical control switches, independent of the size and shape of the switch handle and/or the switch base. Thus, lockout device 100 better prevents accidental or unauthorized manipulation of the electrical control switch. Further, lockout device 100 is less prone to breaking and/or malfunction than other switch-covering type lockout mechanisms because it includes fewer moving components than many conventional switch-covering type lockout mechanisms and is fabricated from durable materials.

Furthermore, because lockout device 100 is fabricated from a clear plastic material, a position of the switch and/or indicator lights can be viewed through the lockout device and a user can be assured that the electrical control switch is in the desired position. Further still, as the surface of lockout device 100 is suitable for marking with a permanent or non-permanent felt pen, a user may mark the lockout device with important information (e.g., time or date that the lockout device was applied, why it was applied, who applied the device, the intended duration of lockout, etc.) that can be viewed by the user and/or other electrical system operators.

Figure 2:
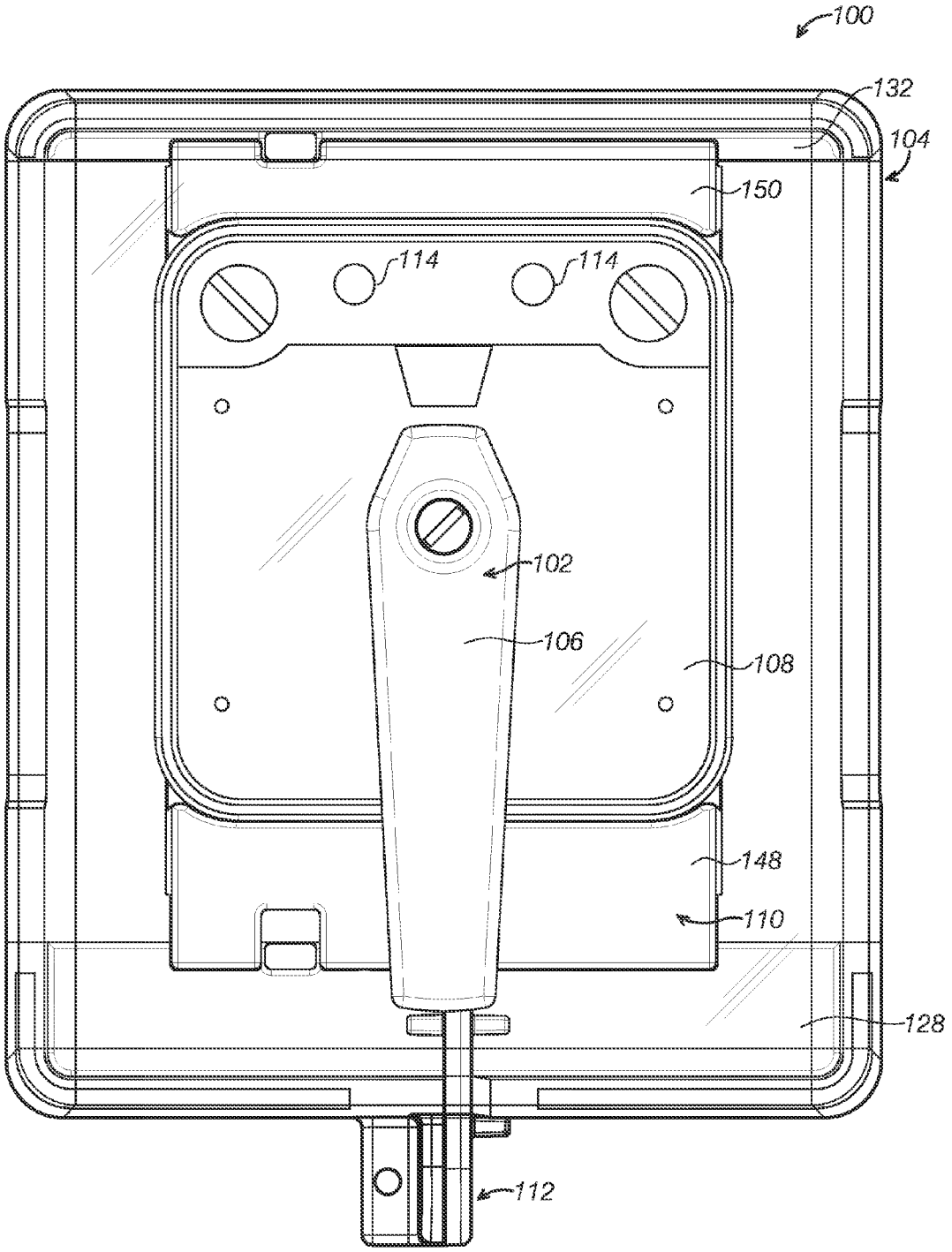
FIG. 2 is a top view of the lockout device and electrical control switch shown in FIG. 1.

As shown in FIGS. 1 and 2, lockout device 100 includes housing 104 that is fitted over electrical control switch 102, which includes an electrical control switch handle 106 and an electrical control switch base 108. Housing 104 is engageable with a second component of lockout device 100, a base adapter 110. Base adapter 110 is secured to electrical control switch base 108. A locking mechanism 112 is provided to secure housing 104 to base adapter 110. As depicted, housing 104 substantially covers and maintains a position of electrical control switch 102, but permits viewing of the position of electrical control switch handle 106 and/or illumination of indicator lights 114.

Figure 3:
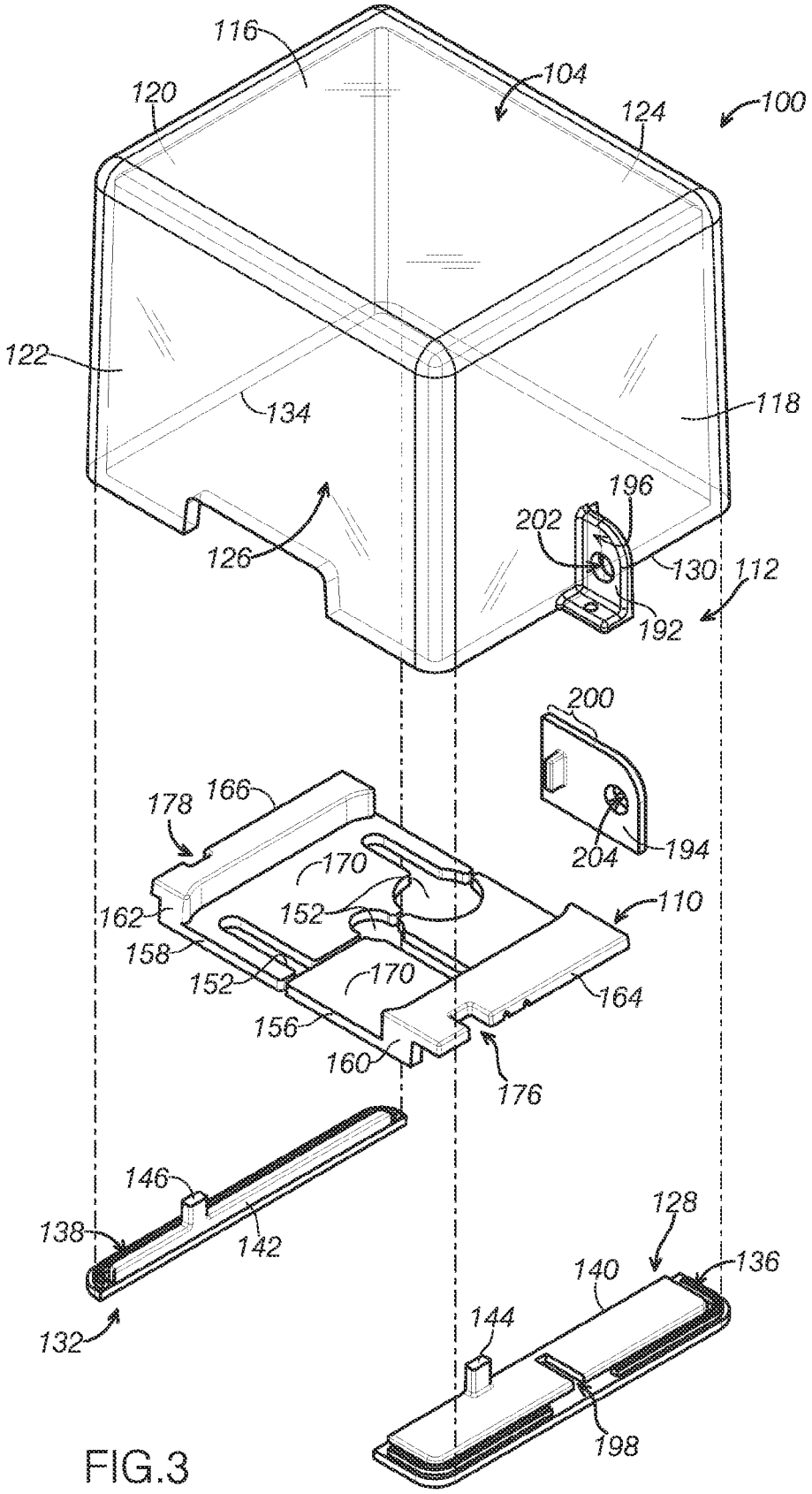
FIG. 3 is an exploded view of the first example of a lockout device shown in FIG. 1.

FIG. 3 shows an exploded view of lockout device 100. As shown in FIG. 3, housing 104 includes a top wall 116, a first lateral wall 118, a second lateral wall 120, a first longitudinal wall 122, a second longitudinal wall 124, and an opening 126. Opening 126 is disposed on an opposing side relative to top wall 116. The walls of the housing substantially define an interior space of the housing and the opening is on one side of the housing. The opening is configured to fit over the electrical switch, the electrical switch base, and the base adapter.

It will be appreciated that dimensions of the top wall, the first and second lateral walls, and the first and second longitudinal walls may be of any lengths that are suitable for constructing a housing that will fit over and substantially cover an electrical control switch. For example, the dimensions of the housing may be 5 in×3.5 in×3.5 in. It will be further appreciated that although the shape of housing shown in the figures is generally a cuboid, the housing may have any shape suitable for covering the electrical control switch (e.g., cube, pyramid, trapezoidal prism, etc.).

Returning to FIG. 3, a first lateral lip 128 is affixable to a bottom edge 130 of lateral wall 118. A second lateral lip 132 is affixable to a bottom edge 134 of lateral wall 120. Bottom edge 130 is insertable and fixable in a channel 136 and bottom edge 134 is insertable and fixable in a channel 138. Channels 136 and 138 extend around three sides of an outer perimeter of first lateral lip 128 and an outer perimeter of second lateral lip 138, respectively. In other words, the channels do not extend across inner edges of the first lateral lip and the second lateral lip, as the inner edges (i.e., inner edges 140 and 142, respectively) do not contact the bottom edges of the walls of the housing. Further, a first vertical projection 144 is extended upward from inner edge 140 and a second vertical projection is extended upward from inner edge 142.

The first and second lateral lips can be attached via an adhesive (e.g., acrylic cement, etc.). In alternative examples, the lateral lips can be attached via an adhering process (e.g., sonic welding, etc.). In even other alternative examples, the first and second lateral lips can be attached via a snap-fit mechanism (i.e., a flange in a wall of the first and second lip snap-fit over a projection on the bottom edges of the lateral walls). In still other examples, the first and the second lip can be continuous with (e.g., molded with) the bottom edges of the lateral walls.

Figure 4:
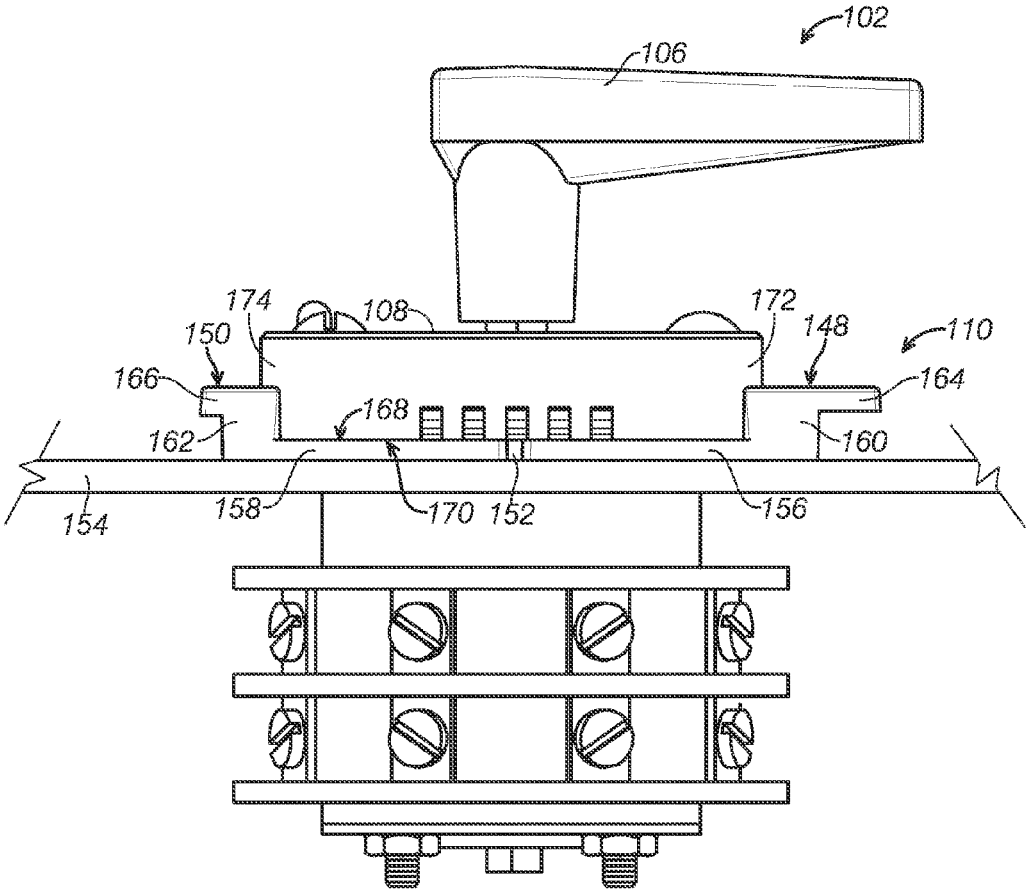
FIG. 4 is side view of the electrical control switch of FIG. 1 with a first example base adapter.

First lateral lip 128 and second lateral lip 132 are configured to be engageable with base adapter 110. As shown in FIG. 4, base adapter 110 is configured to be fitted under electrical switch base 108. In the present example, base adapter 110 includes a first member 148 and a second member 150. A space 152 is disposed first member 148 and second member 150 to allow the two members to be separated and fitted around the components (e.g., wires, cables, fastening members, etc.) of the electrical switch and electrical switch base. In other words, the base adapter is a two piece base adapter configured to be slideable under the electrical switch base (i.e., between electrical switch base 108 and an underlying surface 154) and fitted around the electrical switch base without disassembling the electrical switch.

Each of first member 148 and second member 150 include an underlying wall (156 and 158, respectively) and a vertical wall (160 and 162, respectively). Electrical switch base 108 is disposed between vertical walls 160 and 162 and a bottom surface 168 of the electrical switch base contacts a top surface 170 of underlying walls 156 and 158. A forward edge 172 of the electrical switch base is partially extended over vertical wall 160 and a rearward edge 174 of the electrical switch base is partially extended over vertical wall 162. The edges of the electrical switch base over the vertical walls of the base adapter can assist in resisting movement of the base adapter if an upward force (i.e., a force away from an underlying surface where the electrical switch base is attached) is applied on the base adapter.

Figure 6:
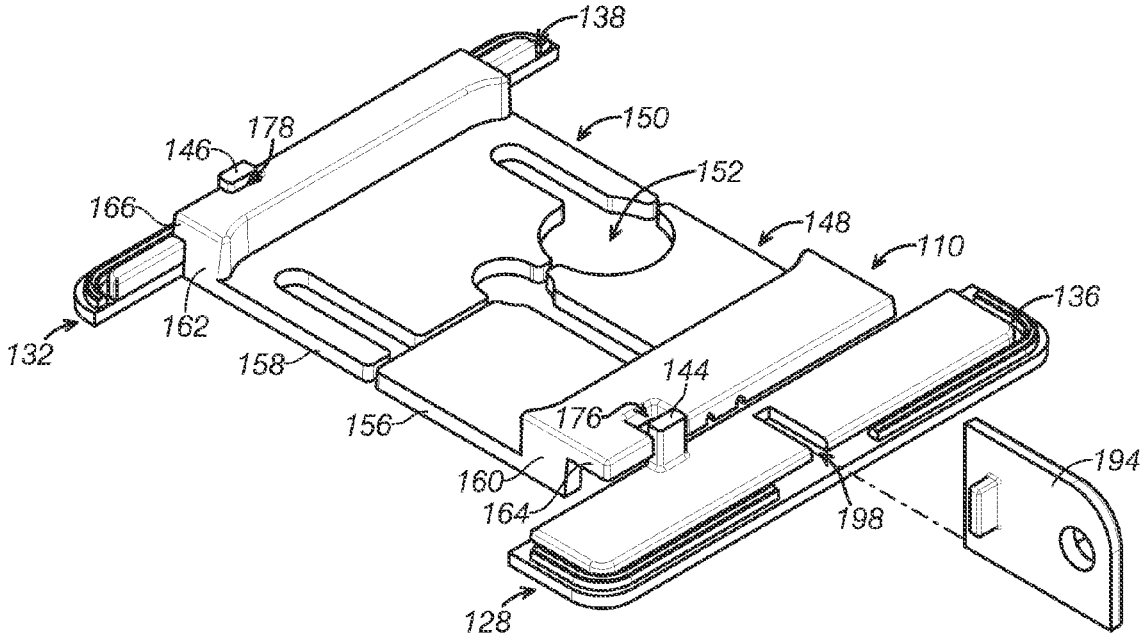
FIG. 6 is a perspective view of the first example base adapter, a first lateral lip, a second lateral lip, and a moveable tab.
Figure 7A:
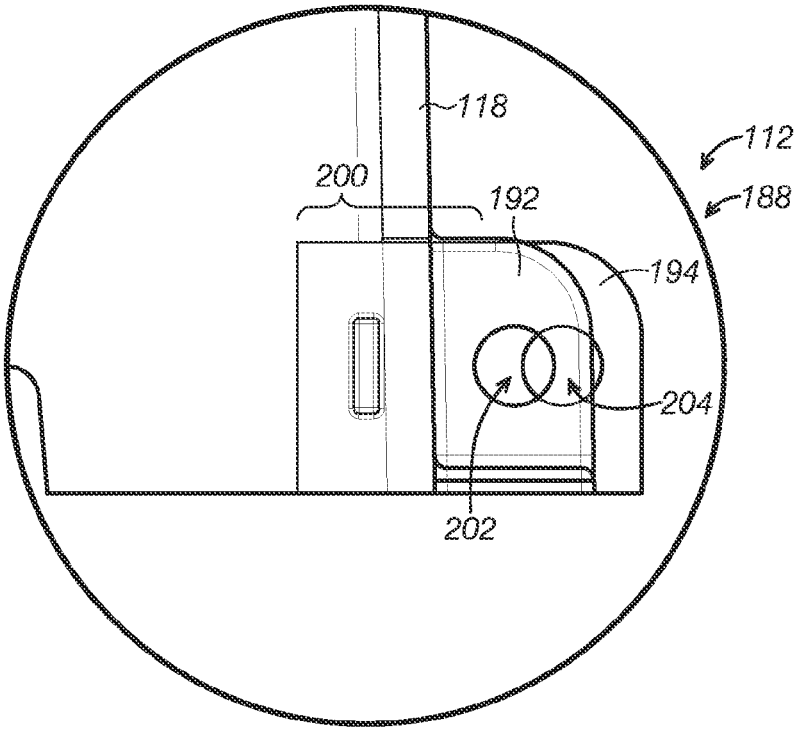
FIGS. 7A and 7B show side elevation views of the first example of a lockout device in an unlocked position and a locked position, respectively.
Figure 7B:
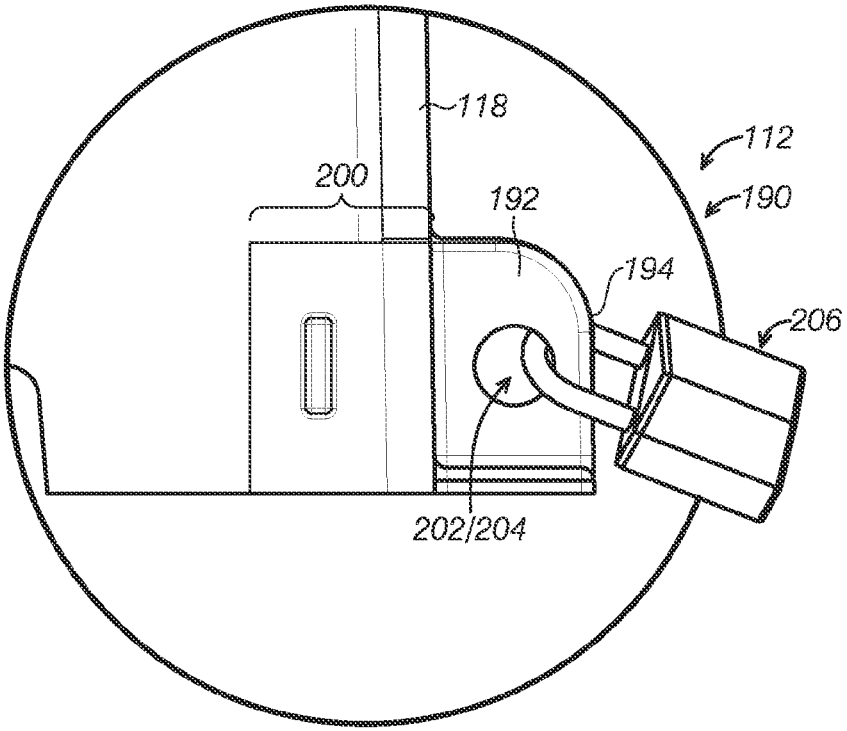

A top of vertical wall 160 includes a forward projecting overhang 164 and a top of vertical wall 162 includes a rearward projecting overhang 166. As shown in FIGS. 3 and 6, forward projecting overhang includes a cutout 176 configured to receive vertical projection 144 and rearward projecting overhang 166 includes a cutout 178 configured to receive vertical projection 146. The vertical projections and the cutouts are further configured to align the first lateral lip and the second lateral lip during engagement with the base adapter. Optionally, additional cutouts can be included in the forward and rearward projecting overhangs adjacent to cutouts 176 and 178 (e.g., at locations of notches shown in the forward projecting overhang in FIG. 6). These additional cutouts can be used to facilitate re-positioning of the cover in order to accommodate alternative positioning of the control switch (e.g., the control switch being parallel to the lateral lips).

Figure 5A:
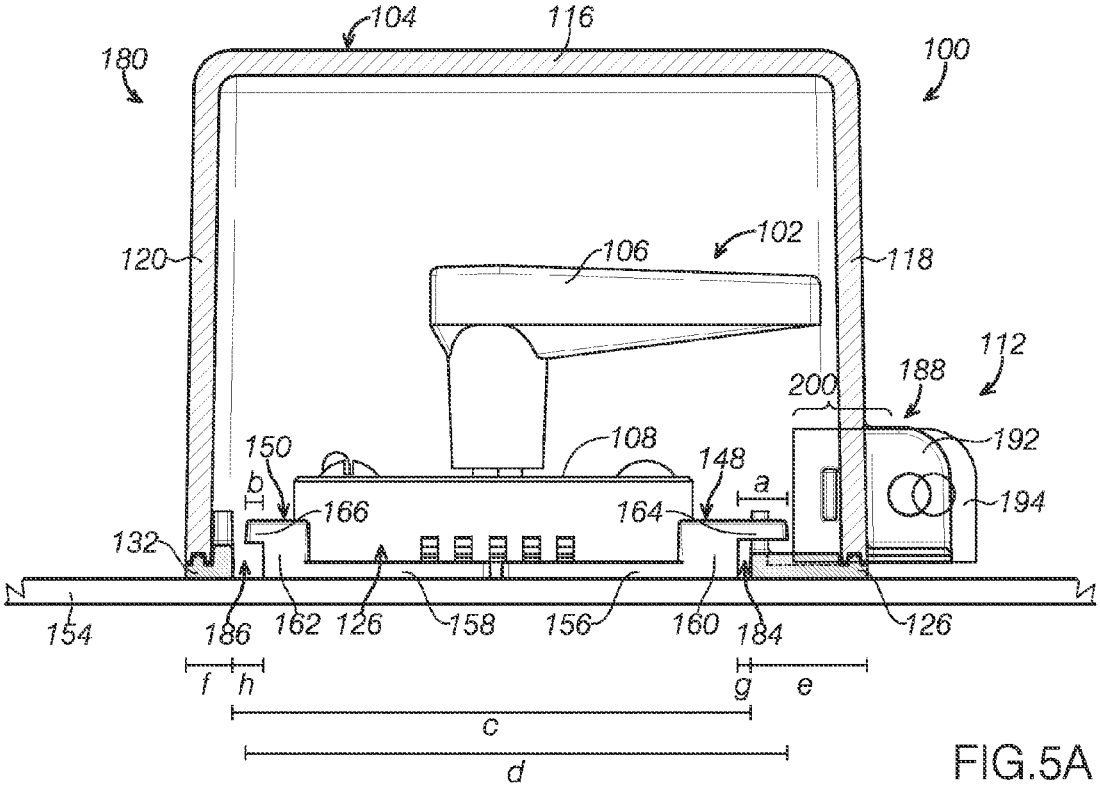
FIGS. 5A and 5B are cross-sectional views of the first example of a lockout device shown in FIG. 1 in a disengaged position and an engaged position, respectively.
Figure 5B:
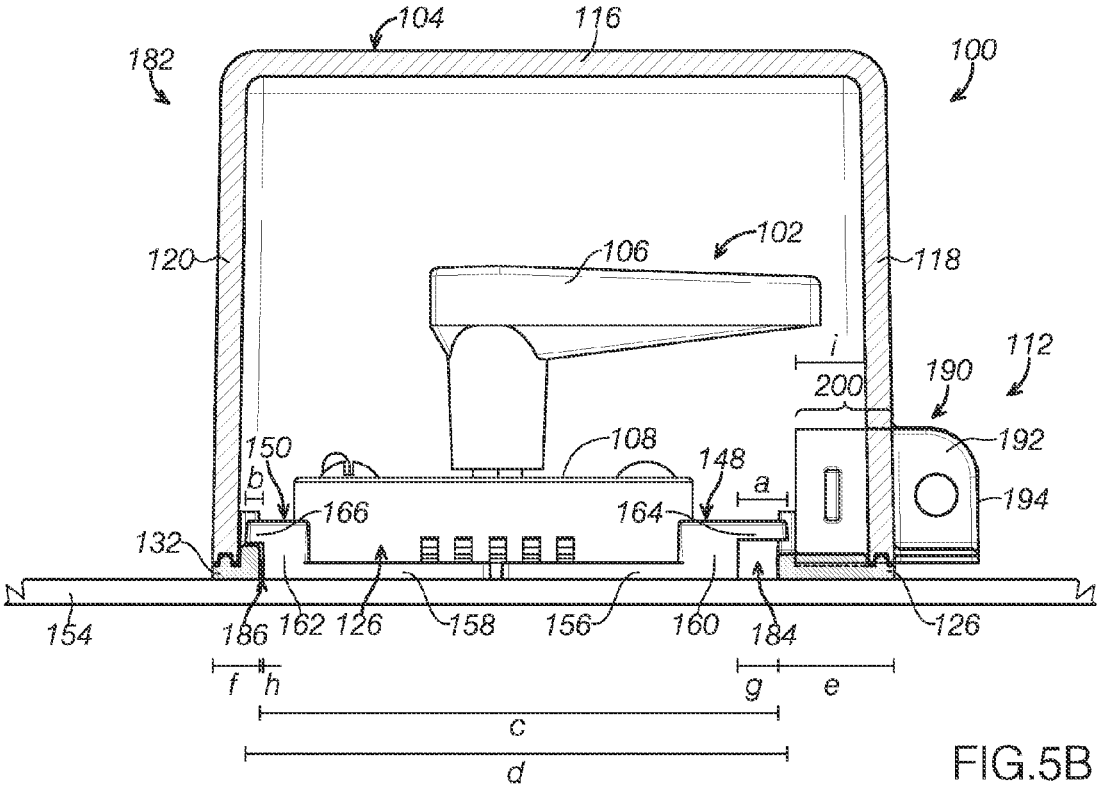

Turning now to FIGS. 5A and 5B, lockout device 100 is shown in a disengaged position 180 and an engaged position 182, respectively. In disengaged position 180, the housing can placed over the electrical control switch and can be removed from the electrical control switch. In engaged position 182, the housing resists removal from the electrical control switch. More specifically, if a force is applied on the housing by a user trying to lift the housing away from the electrical control switch, the forward and rear projecting overhangs will provide and equal opposing force on the first and second lateral bottom lips, respectively. Thus, the housing will not be lifted and will continue to substantially cover the electrical control switch. The engagement and/or connection between the first lateral bottom lip of the housing and the forward projecting overhang of the base adapter and the connection between the second lateral bottom lip of the housing and the rear projecting overhang of the base adapter are the primary mechanism for releasably engaging the housing to the base adapter. This mechanism is described in further detail below.

As shown in FIGS. 5A and 5B, forward projecting overhang 164 has a length a and rear projecting overhang 166 has a length b. The length a is greater than the length b. In one specific example, a is a length of 0.325 in and b is a length of 0.125 in. Further, opening 126 (with attached lateral lips 126 and 132) has a length c and base adapter 110 has a length d. The length d is greater than the length c. In one specific example, the length c is 4.00 in and the length d is 4.21 in. Furthermore, first lateral lip 126 has a length e and second lateral lip 166 has a length f. The length e is greater than the length f. In one specific example, e is a length of 0.64 in and f is a length of 0.45 in.

Also shown in FIGS. 5A and 5B, a space 184 is disposed between vertical wall 160 and lateral lip 126 and a space 186 is disposed between vertical wall 162 and lateral lip 132. Space 184 has a length g and space 184 has a length h. In disengaged position 180 depicted in FIG. 5A, the length g is greater than the length h. Thus, in the disengaged position, the first lateral lip is partially disposed underneath the forward projecting overhang and the second lateral lip is free of the rearward projecting overhang (i.e., the second lateral lip is not disposed underneath the rearward projecting overhang). In one specific example, g has a length 0.08 in and h has a length 0.12 in.

It will be appreciated that housing is moveable (slideable) in a longitudinal direction over between the underlying surface and the base adapter, and therefore the first and second lateral lips are moveable in a longitudinal direction underneath the forward and rear projecting overhangs of the base adapter. Thus, the lengths g and h are variable and have an inverse relationship when the housing is moved between the disengaged position (shown in FIG. 5A) and the engaged position (shown in FIG. 5B).

Accordingly, in an engaged position 182 depicted in FIG. 5B, the length g is less than the length h. Thus, in the engaged position, the first lateral lip is partially disposed underneath the forward projecting overhang (to lesser degree than in the disengaged position) and the second lateral lip is partially disposed underneath the rearward projecting overhang. In one specific example, g has a length of 0.2 in and b has a length that is substantially 0.0 in (i.e., close to 0.0 in).

Locking mechanism 112 is configured to resist movement (e.g., longitudinal sliding) of the housing in a locked position and allow movement of the housing in an unlocked position. Accordingly, locking mechanism 112 is moveable between an unlocked position 188 (shown in FIGS. 5A and 7A) and a locked position 190 (shown in FIGS. 5B and 7B).

Locking mechanism 112 includes a fixed tab 192 that is affixed to and/or continuous with lateral wall 118 of the housing proximal to lateral edge 130 and a moveable tab 194 that is a separate piece. Moveable tab 194 is slideable through a slotted opening 196 (shown in FIG. 3) in lateral wall 118 and adjacent to fixed tab 192. Slotted opening 196 is aligned with a groove 198 (shown in FIGS. 3 and 6) in lateral lip 128. Therefore, moveable tab 194 is simultaneously slideable through groove 198 as it moves through slotted opening 196.

Moveable tab 194 includes an abutting portion 200 that is extended into the housing beyond lateral wall 118. In locked position 190, abutting portion 200 is extended into the housing such that an end of the abutting portion is proximal to or in contact with forward projecting overhang 164. As shown in FIG. 5B, abutting portion 200 has a length i, which is slightly less than the length e. In one specific example, the length i is 0.5 in.

Further, fixed tab 192 includes a central hole 202 and moveable tab 194 includes a central hole 204. In unlocked position 192, central holes 202 and 204 are offset relative to each other, however, in locked position 190 central holes 202 and aligned and configured to receive a retaining mechanism. The retaining mechanism (when disposed in the aligned central holes of the tabs) substantially maintains a position of moveable tab 194 and resists movement of housing 104 (i.e., substantially maintains the engaged position of the housing). In one example, shown in FIG. 7B, the retaining mechanism is a key lock 206. In alternate examples, the retaining mechanism can be a combination lock, a key lock, a zip tie, a wire, or any other retaining mechanism known or yet to be discovered. It will be appreciated that the retaining mechanism can be selectively removed so that the moveable tab can be slid out of the slotted opening and the housing can be selectively moved into the disengaged position and removed from the electrical switch.

Figure 8A:
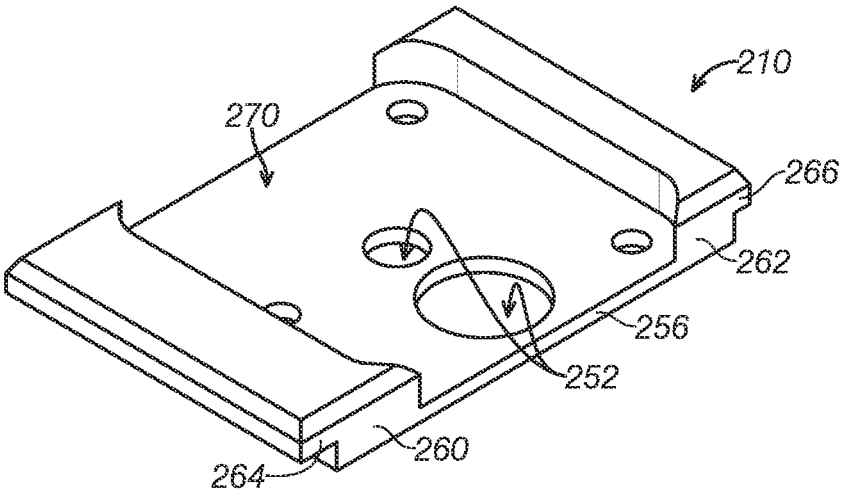
FIGS. 8A-8C are perspective, side elevation, and top plan views of a second example base adapter.
Figure 8B:
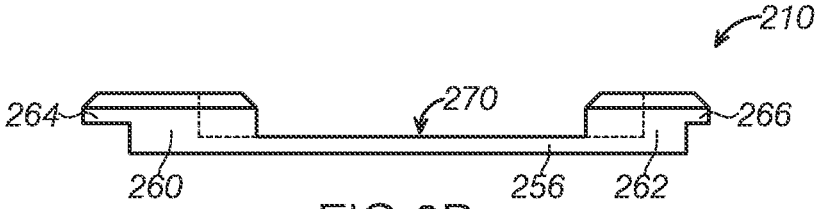
Figure 8C:
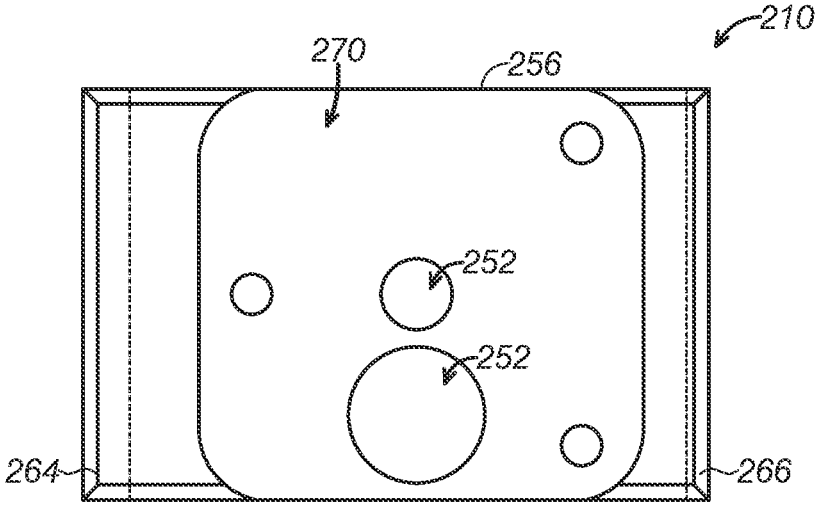

Turning attention to FIGS. 8A-C, a second example of a base adapter, base adapter 210, will now be described. Base adapter includes many similar or identical features to base adapter 110. Thus, for the sake of brevity, each feature of base adapter 210 will not be redundantly explained. Rather, key distinctions between base adapter 210 and base adapter 110 will be described in detail and the reader should reference the discussion above for features substantially similar between the two base adapters. It will be appreciated that base adapter 210 is configured to be fitted under electrical switch base 108 and first lateral lip 128 and second lateral lip 132 are configured to be engageable with base adapter 210.

As can be seen in FIGS. 8A-C, base adapter 210 is a single piece base adapter. Accordingly, base adapter 210 includes a space 252 to allow the base adapter to be fitted around the components (e.g., wires, cables, fastening members, etc.) of the electrical switch and electrical switch base. In other words, the base adapter is a one piece base adapter configured to be affixed under the electrical switch base (i.e., between electrical switch base 108 and an underlying surface 154) and fitted around the electrical switch base. In order to affix base adapter 210, disassembly of the electrical switch and the electrical switch base from the underlying surface may be required.

Base adapter 210 includes an underlying wall 256 and vertical walls 260 and 262 at opposing ends of underlying wall 256. Electrical switch base 108 configured to be disposed between vertical walls 260 and 262 and a bottom surface 168 of the electrical switch base can contact a top surface 270 of underlying wall 256. A forward edge 172 of the electrical switch base can be partially extended over vertical wall 260 and a rearward edge 174 of the electrical switch base can be partially extended over vertical wall 262.

The edges of the electrical switch base over the vertical walls of the base adapter can assist in resisting movement of the base adapter if an upward force (i.e., a force away from an underlying surface where the electrical switch base is attached) is applied on the base adapter. It will be appreciated that although base adapter 210 is not specifically shown in combination with the electrical switch base, reference can be made to FIG. 4 of the application.

A top of vertical wall 260 includes a forward projecting overhang 264 and a top of vertical wall 262 includes a rearward projecting overhang 266. Although not specifically depicted in the present example, in alternate examples, the forward projecting overhang can include a cutout configured to receive vertical projection 144 and the rearward projecting overhang can include a cutout configured to receive vertical projection 146. In these alternate examples, the vertical projections and the cutouts are further configured to align the first lateral lip and the second lateral lip during engagement with the base adapter.

As described above, in the present example, lockout device 100 is fabricated from a clear plastic material (e.g., plexiglass, acrylic, butyrate, lexan, PETG, etc.) that permits viewing of the electrical control switch and is suitable for marking with a felt pen. Because lockout device 100 is fabricated from a clear plastic material, a position of the switch and/or indicator lights can be viewed through the lockout device and a user can be assured that the electrical control switch is in the desired position. Further still, as the surface of lockout device 100 is suitable for marking with a permanent or non-permanent felt pen, a user may mark the lockout device with important information (e.g., time or date that the lockout device was applied, why it was applied, who applied the device, the intended duration of lockout, etc.) that can be viewed by the user and/or other electrical system operators. It will be appreciated that in alternate examples, the lockout device can be fabricated from a different material such as wood, a metallic material, opaque plastic, etc. In these alternate examples, the lockout device can include a window for viewing a position of the electrical switch.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. An electrical switch lockout device for selectively maintaining a position of an electrical switch disposed on an electrical switch base, the electrical lockout device comprising:

a base adapter configured to be fitted around the electrical switch base;

a housing that is moveable between an engaged and a disengaged position, the housing having:

a plurality of walls substantially defining an interior space of the housing, an opening on one side of the housing, the opening configured to fit over the electrical switch, the electrical switch base, and the base adapter, a first lateral lip disposed on a first edge of the opening on a first side of the housing, the first lateral lip configured to engage with the base adapter in the engaged position, and a second lateral lip disposed a second edge of the opening on a second side of the housing, the second lateral lip configured to engage with the base adapter in the engaged position, the second side of the housing being an opposing side relative to the first side of the housing; and a locking mechanism configured to selectively fix the housing in the engaged position, the locking mechanism being selectively moveable between a locked position and an unlocked position, wherein the locking mechanism comprises a fixed tab projected outwardly from the housing on the first side of the housing, a slotted opening in the housing on the first side of the housing and adjacent to the fixed tab, and a moveable tab that is insertable into the slotted opening.

2. The electrical switch lockout device of claim 1, wherein the base adapter comprises a forward projecting overhang and a rearward projecting overhang, the forward projecting overhang being proximal to the first side of the housing and the rearward projecting overhang being proximal to the second side of the housing in the engaged and disengaged positions.

3. The electrical switch lockout device of claim 2, wherein the first lateral lip is configured to be at least partially disposed under the forward projecting overhang and the second lateral lip is free of the rearward projecting overhang in the disengaged position.

4. The electrical switch lockout device of claim 2, wherein the first lateral lip is configured to be at least partially disposed under the forward projecting overhang and the second lateral lip is configured to be at least partially disposed under the rearward projecting overhang in the engaged position.

5. The electrical switch lockout device of claim 1, wherein the housing is slideable between the disengaged position and the engaged position.

6. The electrical switch lockout device of claim wherein the fixed tab has a first central hole and the moveable tab has a second central hole, and wherein the first and the second central holes are aligned in the locked position and configured to receive a retaining mechanism that resists movement of the aligned first and second central holes.

7. The electrical switch lockout device of claim 6, wherein the retaining mechanism is one or more of a combination lock, a key lock, a zip tie, and a wire.

8. The electrical switch lockout device of claim 1, wherein the moveable tab is at least partially extended into the housing through the slotted opening and abutted against the forward projecting overhang in the locked position in order to resist movement of the housing.

9. The electrical switch lockout device of claim 1, wherein the base adapter is a two piece base adapter configured to be slideable under the electrical switch base and fitted around the electrical switch base without disassembling the electrical switch.

10. The electrical switch lockout device of claim 1, wherein the base adapter is a single piece base adapter configured to be installed under the electrical switch base and fitted around the electrical switch base via disassembly and reassembly of the electrical switch.

11. The electrical switch lockout device of claim 1, wherein the housing is comprised of a transparent material so that the position of the electrical switch is viewable through the housing.

12. An electrical switch lockout device for selectively maintaining a position of an electrical switch disposed on an electrical switch base, the electrical lockout device comprising:

a base adapter configured to be fitted around the electrical switch base, the base adapter having a forward projecting overhang and a rearward projecting overhang;

a housing that is moveable between an engaged and a disengaged position, the housing having:

a plurality of walls substantially defining an interior space of the housing, an opening on one side of the housing, the opening configured to fit over the electrical switch, the electrical switch base, and the base adapter, a first lateral lip disposed on a first edge of the opening on a first side of the housing, the first lateral lip configured to engage with the forward projecting overhang in the engaged position, and a second lateral lip disposed a second edge of the opening on a second side of the housing, the second lateral lip configured to engage with the rearward projecting overhang in the engaged position; and a locking mechanism configured to selectively fix the housing in the engaged position, the locking mechanism being selectively moveable between a locked position and an unlocked position, wherein the locking mechanism comprises a fixed tab projected outwardly from the housing on the first side of the housing, a slotted opening in the housing on the first side of the housing and adjacent to the fixed tab, and a moveable tab that is insertable into the slotted opening, wherein the first lateral lip is configured to be at least partially disposed under the forward projecting overhang and the second lateral lip is free of the rearward projecting overhang in the disengaged position, and wherein the first lateral lip is configured to be at least partially disposed under the forward projecting overhang and the second lateral lip is configured to be at least partially disposed under the rearward projecting overhang in the engaged position.

13. The electrical switch lockout device of claim 12, wherein the fixed tab has a first central hole and the moveable tab has a second central hole, and wherein the first and the second central holes are aligned in the locked position and configured to receive a retaining mechanism that resists movement of the aligned first and second central holes.

14. The electrical switch lockout device of claim 13, wherein the moveable tab is at least partially extended into the housing through the slotted opening and abutted against the forward projecting overhang in the locked position in order to resist movement of the housing when the retaining mechanism is disposed in the aligned first and second holes.

15. The electrical switch lockout device of claim 12, wherein the base adapter is a two piece base adapter configured to be slideable under the electrical switch base and fitted around the electrical switch base without disassembling the electrical switch.

16. The electrical switch lockout device of claim 12, wherein the base adapter is a single piece base adapter configured to be installed under the electrical switch base and fitted around the electrical switch base via disassembly and reassembly of the electrical switch.

17. The electrical switch lockout device of claim 12, wherein the housing is comprised of a transparent material so that the position of the electrical switch is viewable through the housing.

18. An electrical switch lockout device for selectively maintaining a position of an electrical switch disposed on an electrical switch base, the electrical lockout device comprising:

a base adapter configured to be fitted around the electrical switch base, the base adapter having a forward projecting overhang and a rearward projecting overhang;

a housing that is moveable between an engaged and a disengaged position, the housing having:

a plurality of walls substantially defining an interior space of the housing, an opening on one side of the housing, the opening configured to fit over the electrical switch, the electrical switch base, and the base adapter, a first lateral lip disposed on a first edge of the opening on a first side of the housing, the first lateral lip configured to engage with the forward projecting overhang in the engaged position, and a second lateral lip disposed a second edge of the opening on a second side of the housing, the second lateral lip configured to engage with the rearward projecting overhang in the engaged position;

a locking mechanism having a fixed tab projected outwardly from the housing on the first side of the housing, a slotted opening in the housing on the first side of the housing and adjacent to the fixed tab, and a moveable tab that is insertable into the slotted opening, the fixed tab has a first central hole and the moveable tab has a second central hole, the locking mechanism being configured to selectively fix the housing in the engaged position and being selectively moveable between a locked position and an unlocked position, the first and the second central holes being aligned in the locked position; and a retaining means configured to be fitted through the aligned first and second central holes in order to resist movement of the housing, wherein the first lateral lip is configured to be at least partially disposed under the forward projecting overhang and the second lateral lip is free of the rearward projecting overhang in the disengaged position, and wherein the first lateral lip is configured to be at least partially disposed under the forward projecting overhang and the second lateral lip is configured to be at least partially disposed under the rearward projecting overhang in the engaged position.

* * * * *